US006965285B2

(12) United States Patent
Hirabayashi

(10) Patent No.: US 6,965,285 B2
(45) Date of Patent: Nov. 15, 2005

(54) FILTER CIRCUIT

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 116 days.

(21) Appl. No.: 10/245,045

(22) Filed: Sep. 17, 2002

(65) Prior Publication Data

US 2003/0052752 A1 Mar. 20, 2003

(30) Foreign Application Priority Data

Sep. 18, 2001 (JP) ..... P2001-283791

(51) Int. Cl.[7] ..... H01P 3/08

(52) U.S. Cl. ..... 333/205; 333/219; 333/235; 333/262; 333/185

(58) Field of Search ..... 333/205, 202, 333/204–207, 185, 235, 262, 219

(56) References Cited

U.S. PATENT DOCUMENTS

| | | | | |
|---|---|---|---|---|
| 5,515,017 A | * | 5/1996 | Yamada et al. | 333/207 |
| 6,018,282 A | * | 1/2000 | Tsuda | 333/205 |
| 6,606,017 B1 | * | 8/2003 | Xu et al. | 333/205 |
| 2003/0030514 A1 | * | 2/2003 | Suma et al. | 333/206 |

FOREIGN PATENT DOCUMENTS

| | | | | |
|---|---|---|---|---|
| DE | 100 10 086 A | | 9/2000 | |
| EP | 506476 A1 | * | 9/1992 | H01P/1/203 |
| EP | 1 067 618 A | | 1/2001 | |
| JP | 08-008605 A | | 12/1996 | |
| JP | 218705 | * | 8/2000 | |

* cited by examiner

*Primary Examiner*—Robert Pascal
*Assistant Examiner*—Kimberly E Glenn
(74) *Attorney, Agent, or Firm*—Robert J. Depke; Trexler, Bushnell, Giangiorgi, Blackstone & Marr

(57) ABSTRACT

The present invention provides a small, thin filter circuit showing a desired filter characteristic which is highly accurate, and producible with a high efficiency. The filter circuit includes a pair of dielectric insulating layers 2 and 3, upper and lower, each having a ground pattern 11 (16) formed on the main side thereof, and an inner wiring layer 4 formed between the dielectric insulating layers 2 and 3 and having capacitively coupled resonator conductive patterns 6 and 7 each connected at one end thereof to the ground patterns 11 and 16 via inter-layer connecting vias 12 and open-circuited at the other end. The filter circuit has formed on the inner wiring layer 4 thereof a plurality of capacitive load patterns 8 to 10 laid along the peripheries of the open-circuited end of the resonator conductive patterns 6 and 7 and electrically isolated from the ground pattern 16, and on one of the dielectric insulating layers 2 and 3 thereof correspondingly to each of the capacitive load patterns 8 to 10 a plurality of capacitive load adjusting patterns 17 to 19 electrically isolated from the ground patterns, electrically connected by the inter-layer connecting vias 24 to 26 to each other, and selectively connected to the ground pattern 16.

4 Claims, 8 Drawing Sheets

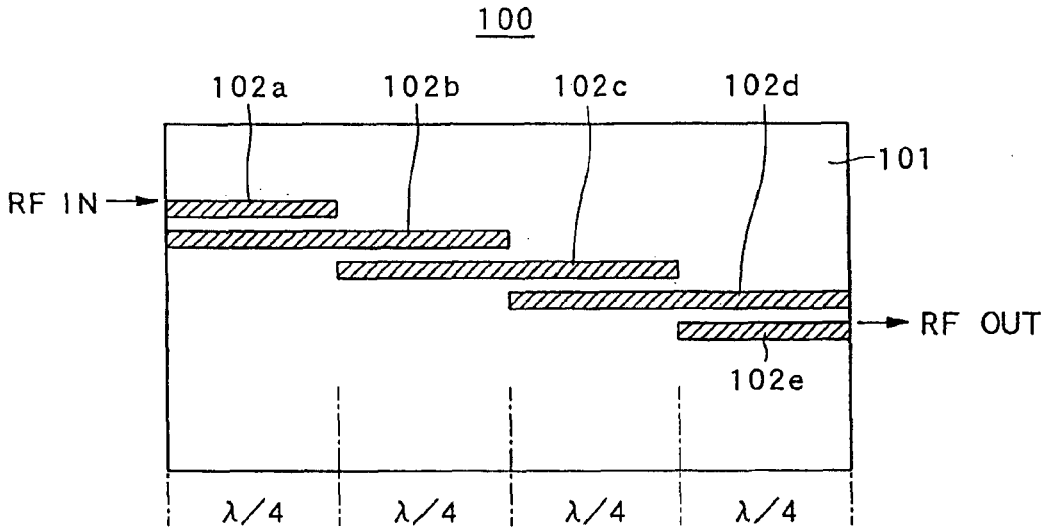
PRIOR ART FIG. 1

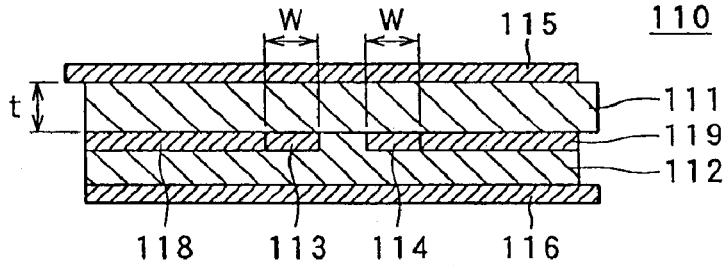
PRIOR ART FIG. 2 (A)
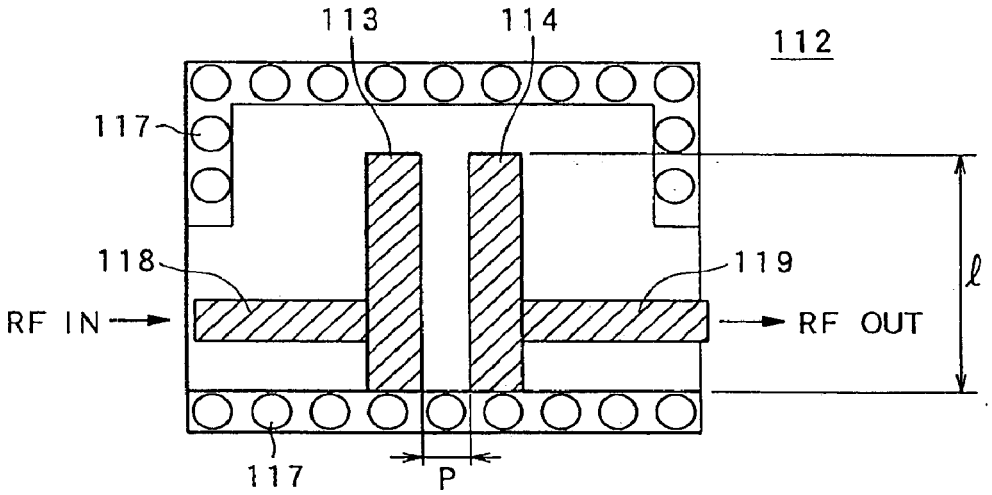
PRIOR ART FIG. 2 (B)
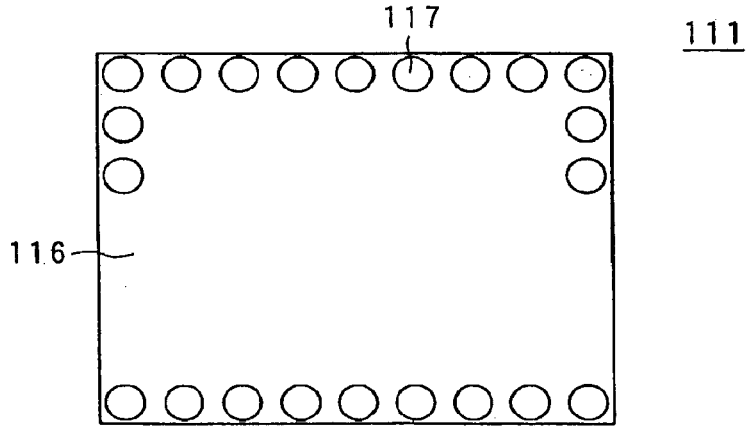
PRIOR ART FIG. 2 (C)

FILTER CIRCUIT

This application claim priority to Japanese Patent Application Number JP 2001-283791 filed Sep. 18, 2001 which is incorporated herein by reference.

BACKGROUND OF THE INVENTION

1. Field of the Invention

The present invention generally relates to a filter circuit to be provided in a radio communication module for microwave and millimeter wave communications, and more particularly, to a filter circuit adjustable to a predetermined bandpass frequency characteristic.

2. Description of the Related Art

Along with the evolution of the information communication technology, the radio communication module is used in various devices and systems such as mobile communication devices, ISDN (integrated service digital network) or computer devices to enable fast communications of data and information, and a small and lightweight design of them, a higher integration or higher multiplication of their functions. In the applications of communications, such as a radio LAN (local area network), in which a frequency in the microwave and millimeter wave bands is used as a carrier frequency, the radio communication module can hardly meet the above-mentioned required specifications such as the small and lightweight design, higher integration and multiplication of functions by any lump parameter design-based circuit using a chip part such as a capacitor or coil as a low-pass filter, high-pass filter, bandpass filter or coupler. To meet such required specifications, the filter circuit has normally be constructed by the method of distributed parameter design using a micro strip line, strip line or the like.

Referring now to FIG. 1, there is illustrated in the formed of a plan view a conventional bandpass filter (BPF) constructed by the method of distributed parameter design. The BPF is generally indicated by a reference 100. As shown in FIG. 1, the BPF 100 includes a dielectric substrate 101 and has a plurality of resonator conductive patterns 102*a* to 102*e* formed like a cascade on the main side (along a micro strip line) of the dielectric substrate 101. The BPF 100 is supplied at one outer conductive pattern 102*a* thereof with a radio frequency signal, selects a predetermined carrier frequency band at the inner conductive patterns 102*b* to 102*d*, and outputs the frequency band at the other outer conductive pattern 102*e*. The conductive patterns 102 except for the middle one 102*c* are connected to each other at the opposite sides of the substrate 101. The substrate 101 has a ground pattern (not shown) formed over the rear side thereof.

In the BPF 100, two adjacent ones of the conductive patterns 102*a* to 102*e* are formed on the main side of the dielectric substrate 101 to overlap each other in a range of a quarter (¼) of a bandpass wavelength λ. Since the conductive patterns 102 are formed on the substrate 101 having a high dielectric constant, the BPF 100 can be designed small by reducing the length of each conductive pattern 102 owing to the effect of wavelength reduction of the micro strip line. The wavelength reduction can be attained at a rate of $\lambda 0/\sqrt{\epsilon\omega}$ (where λ0 is a wavelength in vacuum, and εω is an effective specific inductive capacity; dielectric constant depending upon an electromagnetic field distribution in air and dielectric material) on the surface of the substrate 101, and at a rate of $\lambda 0/\sqrt{\epsilon\gamma}$ (εγ is a specific inductive capacity of the substrate) inside the substrate 101. Also, since the conductive patterns 102 can be formed on the main side of the substrate 101 as in the ordinary wiring board forming process by printing or lithography, the BPF 100 can be formed simultaneously with a circuit pattern or the like.

However, since the conductive patterns 102*a* to 102*e* are formed with the two adjacent ones laid to overlap each other in the range of λ/4, the substrate 101 has to be wide enough for such a layout of the conductive patterns 102. Thus the BPF 100 depends in size upon the substrate 101 and can be designed to have a limited small size.

FIG. 2(A) to FIG. 2(C) and FIG. 3 show together a bandpass filter (BPF) of a conventional tri-plate structure. This BPF is generally indicated with a reference 110. As shown, the BPF 110 has a so-called tri-plate structure in which resonator conductive patterns 113 and 114 are formed between a pair of dielectric substrates 111 and 112 joined to each other. The dielectric substrates 111 and 112 have ground patterns 115 and 116 formed over the outer surfaces, respectively, thereof. Also, the dielectric substrates 111 and 112 have multiple vias 117 formed along the peripheries, respectively, thereof. The front-and rear-side ground patterns 115 and 116 are electrically connected to each other to shield the internal circuit.

The resonator conductive patterns 113 and 114 have a length l nearly equal to a quarter (¼) of the bandpass wavelength λ. They are connected at one end thereof to the ground patterns 115 and 116 and extend in parallel to each other with their other ends being open-circuited. Further, the resonator conductive patterns 113 and 114 have input and output patterns 118 and 119, respectively, formed thereon to project laterally like an arm. Thus, in the BPF 110, the dielectric substrates 111 and 112 and the resonator conductive patterns 113 and 114 are capacitively coupled like an equivalent circuit to provide a parallel resonant circuit, as shown in FIG. 3.

In the aforementioned BPF 110, the frequency characteristics such as passband characteristic, cut-off characteristic and the like depend upon the electromagnetic field distribution between the dielectric substrates 111 and 112 and resonator conductive patterns 113 and 114. In the BPF 110, the field strength varies depending upon the space p between the resonator conductive patterns 113 and 114 in the mode of odd excitation, and depending upon the space between the dielectric substrates 111 and 112 and resonator conductive patterns 113 and 114, that is, the thickness t of the dielectric substrates 111 and 112, in the mode of even excitation. Also, in the BPF 110, the field strength varies depending upon the width w of the resonator conductive patterns 113 and 114.

In the BPF 110, as the field strength varies in the modes of odd excitation and even excitation, the degree of coupling between the resonator conductive patterns 113 and 114 varies and thus the filter characteristic varies. To assure a predetermined filter characteristic, the dielectric substrates 111 and 112 and the resonator conductive patterns 113 and 114 in the BPF 110 are formed with a high precision.

If the manufacturing dimensional precision of each component of the BPF is not always constant, the BPF cannot show a desired filter characteristic in some cases. To avoid this, an adjustment of the BPF has to be done as an additional job by appropriately changing the position, area and the like of the resonator conductive patterns while checking their output characteristic using a measuring instrument, for example. However, the BPF 110 cannot easily be adjusted in such a manner since the resonator conductive patterns 113 and 114 are formed inside the dielectric substrates 111 and 112 as having been described above. Since the components of the BPF 110 have to be produced with a high precision, the BPF 110 cannot be produced with any improved efficiency and yield.

OBJECT AND SUMMARY OF THE INVENTION

It is therefore an object of the present invention to overcome the above-mentioned drawbacks of the related art by providing a filter circuit having a smaller and thinner structure, showing a desired filter characteristic which is highly accurate, and producible with an improved efficiency.

According to the present invention, there is provided a filter circuit including a pair of dielectric insulating layers, upper and lower, each having a ground pattern formed on the main side thereof, and an inner wiring layer formed between the dielectric insulating layers and having capacitively coupled resonator conductive patterns each connected at one end thereof to the ground patterns via inter-layer connecting vias and open-circuited at the other end. The inner wiring layer has formed thereon a plurality of capacitive load patterns laid along the peripheries of the open-circuited end of the resonator conductive patterns and electrically isolated from each other. One of the dielectric insulating layers has formed thereon correspondingly to each capacitive load pattern a plurality of capacitive load adjusting patterns electrically isolated from the ground patterns and electrically connected by the inter-layer connecting vias to each other.

The filter circuit constructed as above can be designed smaller by adopting the tri-plate structure in which the distributed parameter design-based resonator conductive patterns are provided inside each of the dielectric insulating layers. In the filter circuit according to the present invention, the plurality of capacitive load patterns is formed along the peripheries of the resonator conductive patterns and the connection between the capacitive load patterns and ground patterns is adjusted, to thereby adjust the filter characteristic by the resonator conductive patterns. Also in the filter circuit according to the present invention, a plurality of capacitive load adjusting patterns is formed on one of the dielectric insulating layer and the connection between the capacitive load patterns and ground patterns is adjusted on the dielectric insulating layer by the capacitive load adjusting patterns. Therefore, the filter circuit according to the present invention can be adjusted to show a desired filter characteristic even if no predetermined filter characteristic can be assured because the manufacturing dimensional precision of each component of the filter circuit is not always constant. Thus, according to the present invention, the filter circuit having an improved reliability can be produced with an improved efficiency and yield.

These objects and other objects, features and advantages of the present invention will become more apparent from the following detailed description of the preferred embodiments of the present invention when taken in conjunction with the accompanying drawings.

BRIEF DESCRIPTION OF THE DRAWINGS

FIG. 1 is a plan view of a conventional bandpass filter;

FIG. 2(A) to FIG. 2(C) explain a bandpass filter of a conventional tri-plate structure;

DETAILED DESCRIPTION OF THE PREFERRED EMBODIMENTS

Figure 3:
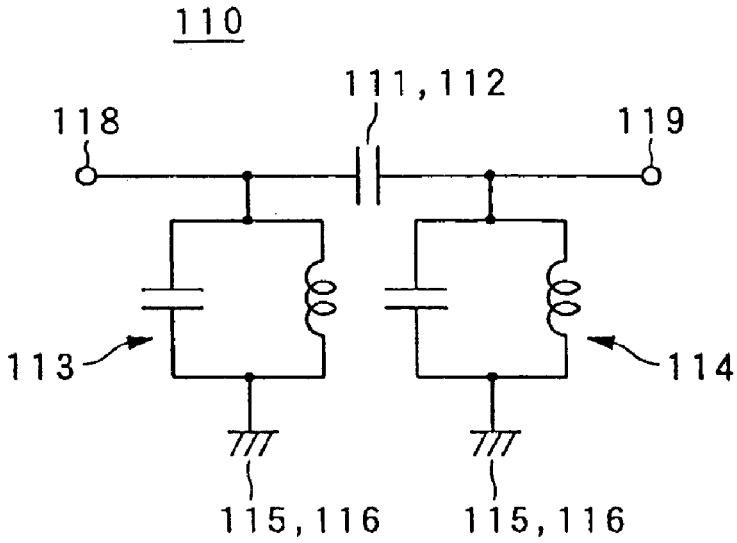
PRIOR ART FIG. 3
FIG. 3 explains the parallel resonant circuit of the bandpass filter in FIG. 2(A) to FIG. 2(C)
Figure 4:
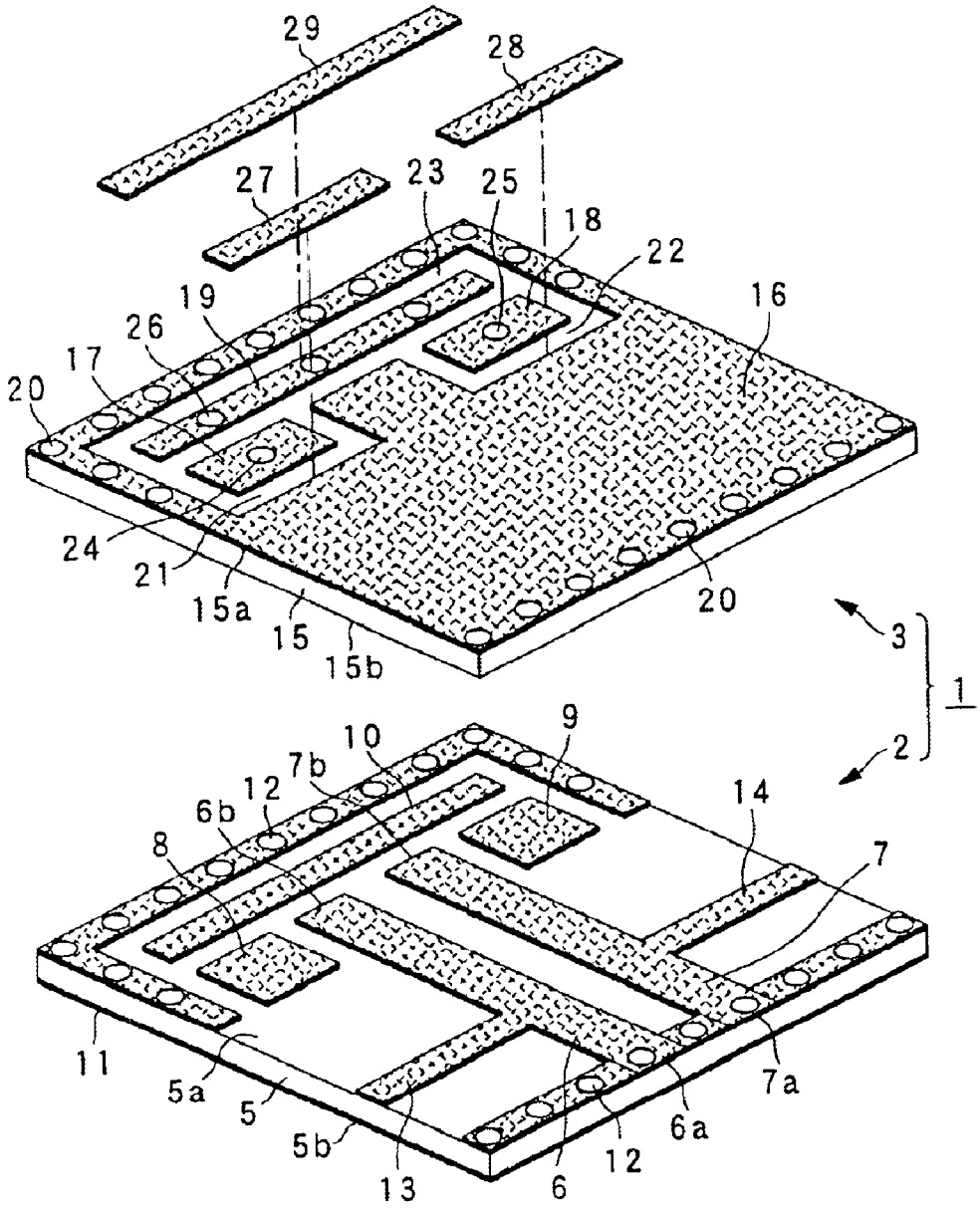
FIG. 4 is an exploded perspective view of a bandpass filter as an embodiment of the present invention.
Figure 5:
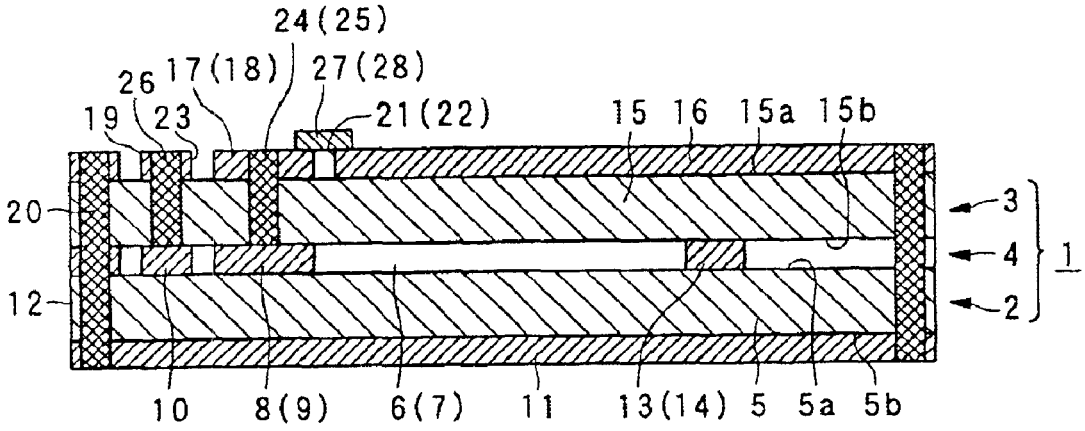
FIG. 5 is an axial-sectional view of the bandpass filter in FIG. 4.

Referring now to FIGS. 4 and 5, there is illustrated in the forms of an exploded perspective view and an axial-sectional view, respectively, an embodiment of the bandpass filter (BPF) according to the present invention. The BPF is generally indicated with a reference 1. As shown, the BPF 1 includes first and second dielectric substrates 2 and 3 between which there is formed a distributed parameter design-based wiring layer 4. Namely, the BPF 1 is of a so-called tri-plate structure. The BPF 1 is used to form a part of an antenna input/output of a communication module (not shown) to pass a to-be-received or-sent signal superposed on a 5-GHz carrier frequency as in the narrow-band communication system defined in the IEEE 802.11a for example and which is to be sent or received via an antenna.

The above first dielectric substrate 2 includes a dielectric insulating layer 5 having a predetermined thickness, resonator conductive patterns 6 and 7 formed on a main side 5*a* of the dielectric insulating layer 5 to form the wiring layer 4 and which will be described in detail later, and first to third capacitive load patterns 8 to 10. The first dielectric substrate 2 has a first ground pattern 11 formed over a second main side 5*b* of the dielectric insulating layer 5. Additionally, the first dielectric substrate 2 has formed along the periphery thereof a plurality of inter-layer connecting vias 12 which provide an electrical connection between the first and second main sides 5*a* and 5*b* of the dielectric insulating layer 5.

The resonator conductive patters 6 and 7 are formed on the first main side 5*a* of the dielectric insulating layer 5 in parallel to each other with their one ends 6*a* and 7*a* extending from one width-directional edge of the dielectric insulating layer 5 and the other ends 6*b* and 7*a* laid near the other width-directional edge. The resonator conductive patterns 6 and 7 are electrically connected at the one ends 6*a* and 7*a* thereof by the inter-layer connecting vias 12, respectively, to the first ground pattern 11. Also, the resonator conductive patterns 6 and 7 are formed by the method of distributed parameter design to have a length (approximately 6 mm) nearly equal to a quarter (¼) of the 5-GHz carrier frequency wavelength (λ) and also have arm-shaped input/output patterns 13 and 14, respectively, formed integrally therewith and extending to the lateral sides, respectively, of the dielectric insulating layer 5.

Further, the first dielectric substrate 2 has the first and second rectangular capacitive load patterns 8 and 9 formed between longitudinal edges thereof and lateral edges of the open-circuited ends 6*b* and 7*b* of the resonator conductive patterns 6 and 7. With the respective inner edges laid opposite to the outer edges, respectively, of the resonator conductive patterns 6 and 7, the first and second capacitive load patterns 8 and 9 are applied with a parallel capacitive load.

Also, the first dielectric substrate 2 has the width-directional rectangular third capacitive load pattern 10 formed between the width-directional edge thereof and tips of the open-circuited ends 6*b* and 7*b* of the resonator conductive patterns 6 and 7. With the inner edge laid opposite to the tips of the resonator conductive patterns 6 and 7 and outer edges of the first and second capacitive load patterns 8 and 9, the third capacitive load pattern 10 is applied with a parallel capacitive load.

The second dielectric substrate 3 includes a dielectric insulating layer 15 having a predetermined thickness, a second ground pattern 16 and first to third capacitive load adjusting patterns 17 to 19 formed on a first main side 15*a* of the dielectric insulating layer 15. The second dielectric substrate 3 has further formed thereon a plurality of inter-layer connecting vias 20 communicating with the inter-layer connecting vias 12 to electrically connect the first and second ground patterns 11 and 16 to each other when the second dielectric substrate 3 is joined to the first dielectric substrate 2 as will be described in detail later.

Further, the second dielectric substrate 3 has the second ground pattern 16 formed over the first main side 15*a* of the dielectric insulating layer 15. With a part of the second ground pattern 16 peeled off in the form of a frame, first to third insulating patterns 21 to 23 are formed to fringe the first to third capacitive load adjusting patterns 17 to 19. The first capacitive load adjusting pattern 17 is formed from a rectangular conductive pattern opposite to the first capacitive load pattern 8 with the second dielectric substrate 3 joined to the first dielectric substrate 2. Also, the first capacitive load adjusting pattern 17 is electrically isolated from the second ground pattern 16 by the first insulating pattern 21.

The second capacitive load adjusting pattern 18 is formed from a rectangular conductive pattern electrically isolated from the second ground pattern 16 by the second insulating pattern 22 and laid opposite to the second capacitive load pattern 9 of the first dielectric substrate 2. The third capacitive load adjusting pattern 19 is formed from a width-directional rectangular conductive pattern electrically isolated from the second ground pattern 16 by the third insulating pattern 23 and laid opposite to the third capacitive load pattern 10 of the first dielectric substrate 2.

The second dielectric substrate 3 first to third inter-layer connecting vias 24 to 26 formed in the first to third capacitive load adjusting patterns 17 to 19, respectively. The first capacitive load adjusting pattern 17 is electrically connected by the first interlayer connecting via 24 to the first capacitive load pattern 8. The second capacitive load adjusting pattern 18 is electrically connected by the second inter-layer connecting via 25 to the second capacitive load pattern 9. The third capacitive load adjusting pattern 19 is electrically connected by the third inter-layer connecting via 26 to the third capacitive load pattern 10.

In the BPF 1 constructed as above, the first and second dielectric substrates 2 and 3 are stacked one on the other and fixed to each other by an adhesive or the like with the first main side 5*a* of the dielectric insulating layer 5 placed vis-a-vis to the second main side 15*b* of the dielectric insulating layer 15, as shown in FIG. 5. In the BPF 1, when the first and second dielectric substrates 2 and 3 are joined to each other, the inter-layer connecting vias 12 and 20 laid opposite to each other communicate with each other and the first ground pattern 11 of the first dielectric substrate 2 and second ground pattern 16 of the second dielectric substrate 3 are electrically connected to each other. It should be noted that generally in the BPF 1, there are formed vias which provide communications between the first and second dielectric substrates 2 and 3 joined to each other, namely, the inter-layer connecting vias.

In the above condition of the BPF 1, the first to third capacitive load adjusting patterns 17 and 19 at the second dielectric substrate 2 are laid opposite to the first to third capacitive load patterns 8 to 10 at the first dielectric substrate 2, respectively, with the dielectric insulating layer 15 placed between them. Further, in the BPF 1, the first to third capacitive load patterns 8 to 10 are electrically connected to the first to third capacitive load adjusting patterns 17 to 19, respectively, by the first to third interlayer connecting vias 24 to 26, respectively.

In the BPF 1, when an input signal received by the antenna is supplied to the input/output pattern 13 at the resonator conductive pattern 6, a signal superposed on a 5-GHz carrier frequency is extracted by the resonator conductive patterns 6 and 7 from the received signal, and outputted from the input/output pattern 14 at the resonator conductive pattern 7. Also, in the BPF 1, a signal superposed on a 5-GHz carrier frequency is extracted from an output signal supplied from an output-side power amplifier to the input/output pattern 14 at the resonator conductive patterns 7, and outputted from the input/output pattern 13 at the resonator conductive pattern 6 to the antenna.

In the BPF 1, the thickness of each of the dielectric insulating layer 5 of the first dielectric substrate 2 and dielectric insulating layer 15 of the second dielectric layer 3, length and width of the resonator conductive patterns 6 and 7 or the area of the first to third capacitive load patterns 8 to 10 are set to assure a filter characteristic which matches the wavelength of the 5-GHz carrier frequency. If the manufacturing dimensional precision of each of the above-mentioned components of the BPF 1 is not always constant, the BPF 1 will not show a predetermined filter characteristic as the case may be.

On the surface of the second dielectric substrate 3 of the BPF 1, there are formed the second ground pattern 16 as well as the first to third capacitive load adjusting patterns 17 to 19 connected by the first to third inter-layer connecting vias 24 to 26 to the first to third capacitive load patterns 8 to 10, respectively. On the surface of the second dielectric substrate 3 of the BPF 1, the first to third capacitive load adjusting patterns 17 to 19 are selectively connected to the second ground pattern 16 to adjust the loading to the resonator conductive patterns 6 and 7 by the first to third capacitive load patterns 8 to 10, thereby adjusting the filter characteristic.

Figure 6:
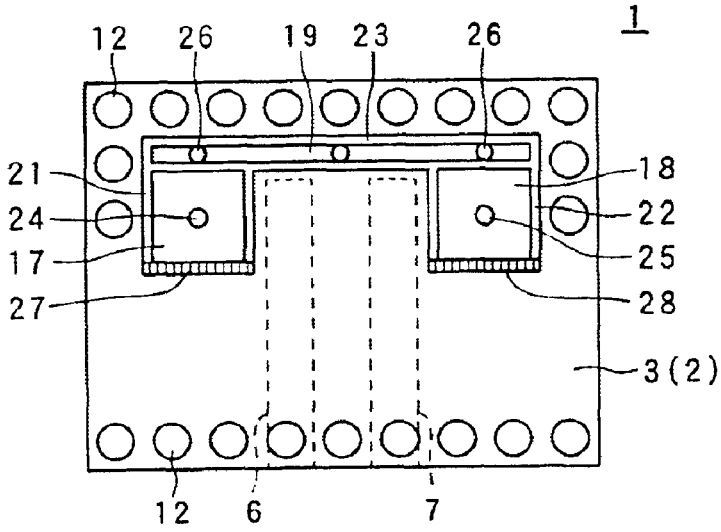
FIG. 6 is a plan view of the bandpass filter in FIG. 4, whose characteristic is adjusted.

As shown in FIGS. 4 and 6, the BPF 1 further includes first to third conductors 27 to 29 formed along appropriate sides of the first to third insulating patterns 21 to 23 defining the first to third capacitive load adjusting patterns 17 and 19, respectively. The first to third conductors 27 to 29 are wider than the sides of the first to third insulating patterns 21 to 23, and electrically connect the first to third insulating patterns 21 to 23 to the second ground pattern 16.

The first to third conductors 27 to 29 are formed from a solder filled along the appropriate sides, respectively, of the first to third insulating patterns 21 to 23, for example. Otherwise, the first to third conductors 27 to 29 may be formed from a metal foil wider than the appropriate sides, respectively, of the first to third insulating patterns 21 to 23, for example. Alternatively, the first to third conductors 27 to 29 may be formed from a conductive paste such as silver paste filled along the appropriate sides, respectively, of the first to third insulating patterns 21 to 23, for example.

Figures 7A, 7B, 7C:
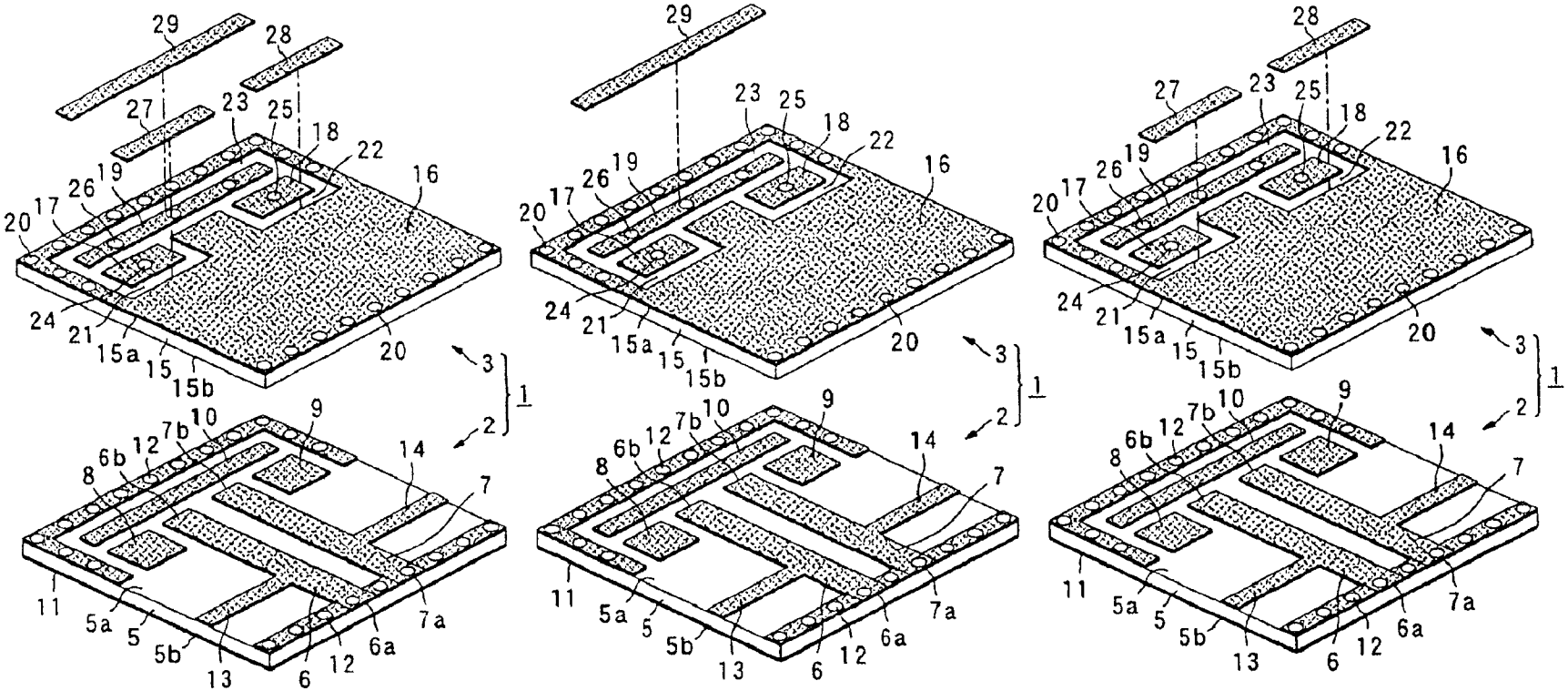
FIG. 7(A) to FIG. 7(C) explain the adjustment of the filter characteristic in the bandpass filter in FIG. 4.

In the BPF 1, a reference signal is supplied to the input/output pattern 13 at the resonator conductive pattern 6, and the first to third capacitive load adjusting patterns 17 to 19 are selectively connected to the aforementioned ground pattern 16, as shown in FIG. 7(A) to FIG. 7(C), while an output from the input/output pattern 14 of the resonator conductor pattern 7 is being measured by a measuring instrument.

FIG. 7(A) shows connection of all the first to third capacitive load adjusting patterns 17 to 19 to the second ground pattern 16, attained when the first to third conductors 27 to 29 have been formed on all the first to third insulating patterns 21 to 23, respectively. Therefore, in the BPF 1, the first to third capacitive load patterns 8 to 10 have the same potential as that at the second ground pattern 16 via the first to third capacitive load adjusting patterns 17 to 19, respectively. Thus in the BPF 1, the resonator conductive patterns 6 and 7 are applied, via the first to third capacitive load patterns 8 to 10, with a parallel capacitive load synthesized by the first to third capacitive load patterns 8 to 10, second ground pattern 16 and first to third capacitive load adjusting patterns 17 to 19.

FIG. 7(B) shows connection of only the third capacitive load adjusting pattern 19 to the second ground pattern 16, attained when the first and second insulating patterns 21 and 22 are kept electrically isolated from each other while the third conductor 29 is formed solely on the third insulating pattern 23. Therefore in the BPF 1, the third capacitive load pattern 10 has the same potential as that at the second ground pattern 16 via the third capacitive load adjusting pattern 19. Thus in the BPF 1, the resonator conductive patterns 6 and 7 are applied, via the first to third capacitive load patterns 8 to 10, with a parallel capacitive load synthesized by the third capacitive load pattern 10, second ground pattern 16 and third capacitive load adjusting pattern 19.

FIG. 7(C) shows connection of the first and second capacitive load adjusting patterns 17 and 18 to the second ground pattern 16, attained when the third insulating pattern 23 is kept electrically isolated while the first and second conductors 27 and 28 are formed on the first and second insulating patterns 21 and 22, respectively. Therefore in the BPF 1, the first and second capacitive load patterns 8 and 9 have the same potential as that at the second ground pattern 16 via the first and second capacitive load adjusting patterns 17 and 18. Thus in the BPF 1, the resonator conductive patterns 6 and 7 are applied, via the first to third capacitive load patterns 8 to 10, with a parallel capacitive load synthesized by the first and second capacitive load patterns 8 and 9, second ground pattern 16 and the first and second capacitive load adjusting patterns 17 and 18.

Figure 8:
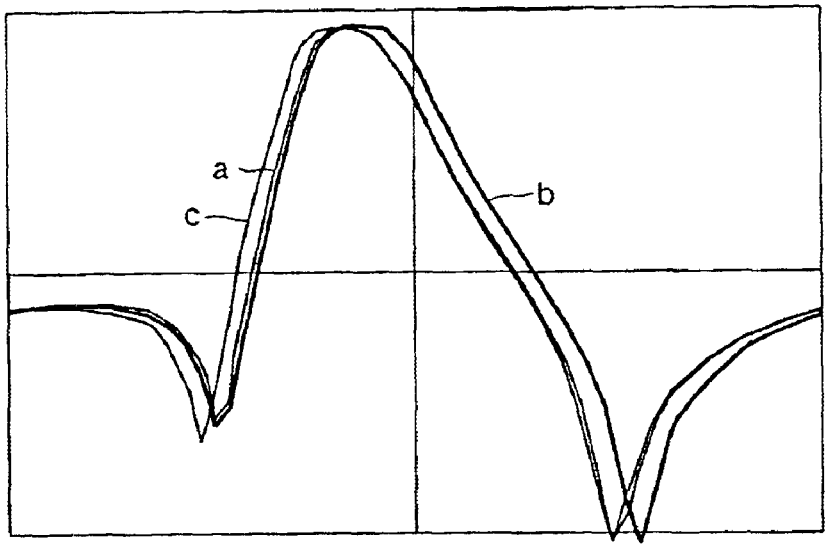
FIG. 8 shows the filter characteristic of the bandpass filter in FIG. 4.

With the above adjustment, the BPF 1 will have a frequency characteristic as shown in FIG. 8. As shown, a solid line a indicates the result of a frequency characteristic simulation made after the connection is done as shown in FIG. 7(A). A solid line b indicates the result of a frequency characteristic simulation made after the connection is done as shown in FIG. 7(B). Also, a solid line c indicates the result of a frequency characteristic simulation made after the connection is done as shown in FIG. 7(C). The BPF 1 is designed to have a 5-GHz frequency characteristic as having been described above, but as evident from FIG. 8, the frequency characteristic can be adjusted by selectively connecting the first to third capacitive load adjusting patterns 17 and 19 to the second ground pattern 16. In other words, any variance of the frequency characteristic of the BPF 1 due to a variation of the manufacturing dimensional precision can thus be compensated.

Figure 9:
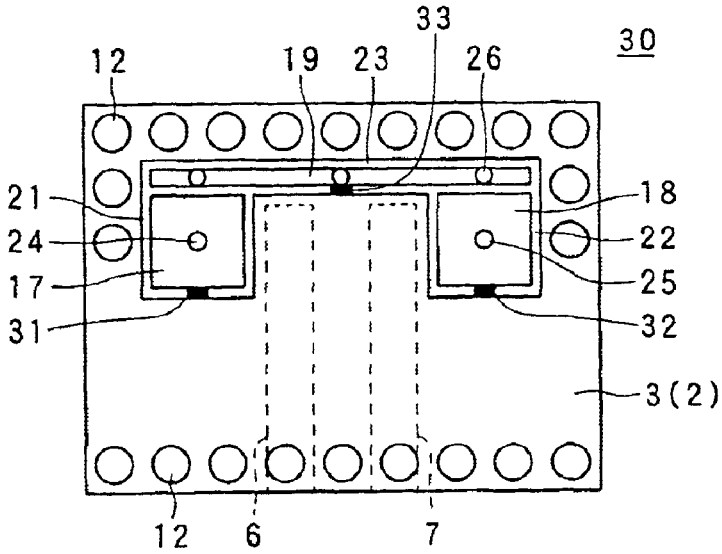
FIG. 9 is a plan view of a bandpass filter as another embodiment, provided with a MEMS switch.

Referring now to FIG. 9, there is illustrated in the form of a plan view another embodiment of the bandpass filter (BPF) according to the present invention. The BPF is generally indicated with a reference 30. The BPF 30 is similar in basic construction to the first embodiment having previously been described provided that first to third MEMS (microelectromechanical system) switches 31 to 33 are provided on the first to third insulating patterns 21 to 23 defining the first to third capacitive load adjusting patterns 17 to 19, respectively. It should be noted that parts of the BPF 30 corresponding to those of the BPF 1 will be indicated with the same references as those for the parts of the BPF 1 but not be explained any longer, in the following description of the BPF 30. In the BPF 30, the first to third capacitive load adjusting patterns 17 to 19 are selectively connected to the second ground pattern 16 by turning on and off the MEMS switches 31 to 33.

Figure 10A:
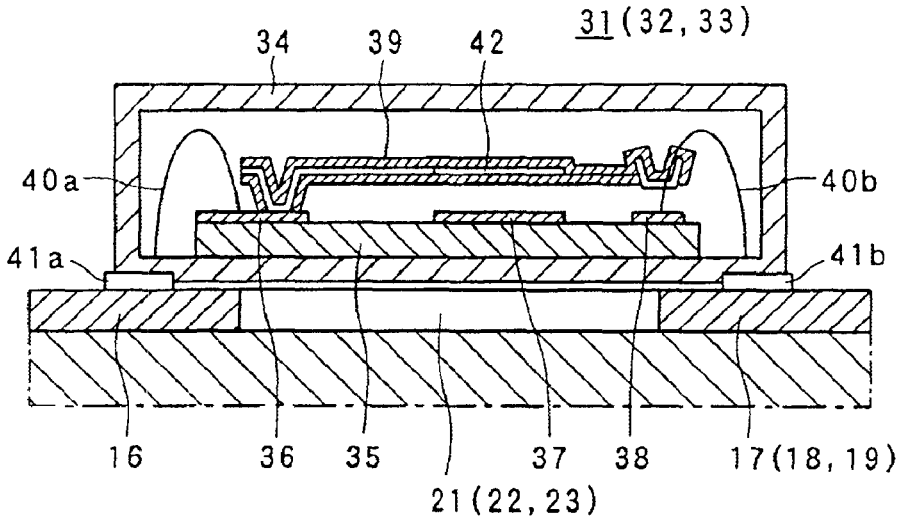
FIG. 10(A) and FIG. 10(B) shows the construction of the MEMS switch.
Figure 10B:
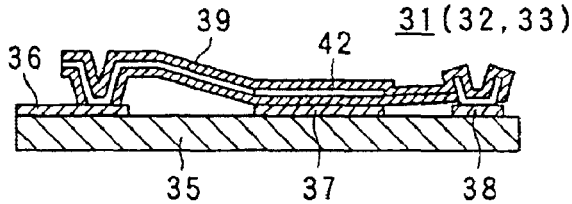

The construction of the first MEMS switch 31 will be described below with reference to FIG. 10(A) and FIG. 10(B). It should be noted that the second and third MEMS switches 32 and 33 are constructed similarly to the first MEMS switch 31 and so they will not be described any more concerning their construction. As shown in FIG. 10(A), the MEMS switch 31 is wholly covered with an insulating cover 34. The MEMS switch 31 includes a silicon substrate 35 and first to third fixed contacts 36 to 38 formed electrically isolated from each other on the silicon substrate 35. The MEMS switch 31 also includes a thin, flexible traveling contact 39 pivotably supported like a cantilever on the first fixed contact 36. In the MEMS switch 31, the first and third fixed contacts 36 and 38 are used as input/output contacts, respectively, and connected, via leads 40*a* and 40*b*, respectively, to input/output terminals 41*a* and 41*b*, respectively, provided on the insulating cover 34.

The traveling contact 39 in the MEMS switch 31 has the one end thereof normally closed to the first fixed contact 36 at the silicon substrate 35 and the free end thereof normally opened from the third fixed contact 38. The traveling contact 39 has an electrode 42 provided inside thereof correspondingly to the second fixed contact 37 formed in the center. Normally, the traveling contact 39 of the MEMS switch 31 has one end thereof put into contact with the first fixed contact 36 and the other end maintained not in contact with the third fixed contact 38, as shown in FIG. 10(A).

The MEMS switch 31 constructed as above is installed on the main side of the second dielectric substrate 3 to cross the first insulating pattern 21 as shown in FIG. 10(A). The MEMS switch 31 is connected at one input/output terminal 41*a* thereof to the second ground pattern 16 and at the other input/output terminal 41*b* to the first capacitive load adjusting pattern 17. Therefore, the MEMS switch 31 normally keeps the second ground pattern 16 and first capacitive load adjusting pattern 17 electrically isolated from each other.

When supplied with a drive signal, an excitation voltage is applied to the MEMS switch 31 at the second fixed contact 37 and internal electrode 42 of the traveling contact 39 thereof. Then, a force is developed in the MEMS switch 31 to attract the second fixed contact 37 and traveling contact 39 toward each other so that the traveling contact 39 will turn about the first fixed contact 36 toward the silicon substrate 35 as shown in FIG. 10(B) until its free end is put into contact with the third fixed contact 38. The traveling contact 39 and third fixed contact 38 will be kept so connected between them. Therefore, in the BPF 30, the second ground pattern 16 and first capacitive load adjusting pattern 17 are connected to each other via the MEMS switch 31.

In the MEMS switch 31, when the second fixed contact 37 and the internal electrode 42 of the traveling contact 39 are applied with a reverse bias excitation voltage, the traveling contact 39 returns from the above-mentioned state to the initial state and is released from the third fixed contact 38. Therefore in the BPF 30, the second ground pattern 16 is disconnected from the first capacitive load adjusting pattern 17. Since the MEMS switch 31 is extremely small in size and does not require any voltage for keeping the in-operation state, installation thereof in the BPF 30 will not add to the size of the latter and thus will lead to a reduced power consumption.

Figure 11:
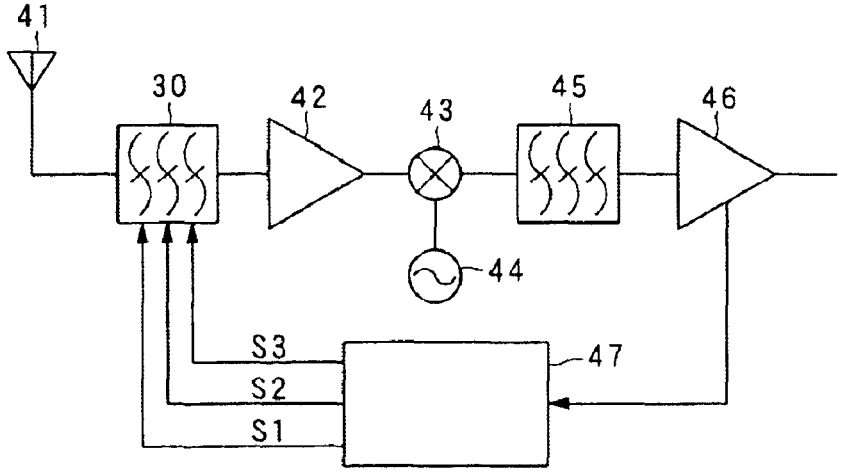
FIG. 11 shows the block diagram of a feedback logic circuit containing a bandpass filter provided with the MEMS switch.

Since the BPF 30 has the characteristic adjusted by turning on and off the first to third MEMS switches 31 to 33, it is usable to form a feedback logic of a bandpass filter circuit 40 as shown in FIG. 11, for example. The bandpass filter circuit 40 has a characteristic to pass a signal superposed on a 5-GHz frequency, and includes a BPF 30, amplifier 42, mixer 43 and transmitter 44 to process a signal received by an antenna 41. The bandpass filter 40 allows a predetermined frequency band outputted from the mixer 43 to pass through a second BPF 45 and supplies it to an received signal amplifier 46.

When the operating ambient condition of an apparatus in which the bandpass filter circuit 40 is installed varies, for example, when a metallic thing or dielectric material is placed close to the apparatus or when the ambient temperature and humidity vary, the frequency characteristic of the BPF 30 varies, possibly resulting in a reduction of the received power from the antenna 41. In the bandpass filter circuit 40, the output level of the received signal amplifier 44 is detected, and when the detected output level is found low, it is sent to a switch drive circuit 47.

In the bandpass filter circuit 40, the switch drive circuit 47 generates control signals s1 to s3 for driving the first to third MEMS switches 31 to 33 and feeds the signals back to the BPF 30. In the bandpass filter circuit 40, the first to third MEMS switches 31 to 33 are selectively turned on and off to fine adjustment of the frequency characteristic as having been described above.

Note that in the aforementioned embodiments of the present invention, the internal wiring layer 4 is formed from the first and second dielectric substrates 2 and 3 joined to each other but it is of course that a plurality of the second dielectric substrates 2 may be stacked one on the other to form a plurality of wiring layers. Also, the BPF may be constructed from a plurality of bandpass filters formed in a multilayer wiring layer.

As having been described in the foregoing, the filter circuit according to the present invention includes the distributed parameter design-based resonator conductive patterns formed in the dielectric insulating layer having the ground pattern formed thereon, the plurality of capacitive load patterns formed around the resonator conductive patterns to apply a parallel capacitive load, and the plurality of capacitive load adjusting patterns formed on the surface of the dielectric insulating layer and connected to the capacitive load patterns. Since the filter circuit uses the tri-plate structure in which the resonator conductive patterns are formed in the dielectric insulating layer, it can be formed smaller. The selective connection of the capacitive load adjusting patterns to the ground pattern on the surface of the dielectric insulating layer makes it possible to adjust the application of a parallel capacitive load from the capacitive load patterns. Therefore, the filter circuit according to the present invention can be set to show an optimum filter characteristic even with an irregularity or variation of the filter characteristic, caused by a non-constant manufacturing dimensional precision, a variation of operating ambient conditions, etc. Thus, the filter circuit can be produced with an improved efficiency and yield and have an improved reliability and performance.

What is claimed is:

1. A filter circuit including a pair of dielectric insulating layers, upper and lower, each having a ground pattern formed on an outer side thereof, and an inner wiring layer formed between the dielectric insulating layers and having capacitively coupled resonator conductive patterns each connected at one end thereof to the ground patterns via inter-layer connecting vias and open-circuited at the other end, the filter circuit having formed:

on the inner wiring layer thereof a plurality of capacitive load patterns adjacent the open-circuit ends of the resonator conductive patterns and electrically isolated from each other; and on one of the dielectric insulating layers, a plurality of capacitive load adjusting patterns each being electrically connected by at least one corresponding inter-layer connecting via to a corresponding capacitive load pattern;

each of the capacitive load adjusting patterns are formed fringed by a frame-shaped insulating pattern between an adjacent portion of the ground pattern; and a predetermined one of the capacitive load adjusting patterns is connected to the ground pattern via a conductive material.

2. A filter circuit including a pair of dielectric insulating layers, upper and lower, each having a ground pattern formed on an outer side thereof, and an inner wiring layer formed between the dielectric insulating layers and having capacitively coupled resonator conductive patterns each connected at one end thereof to the ground patterns via inter-layer connecting vias and open-circuited at the other end, the filter circuit having formed:

on the inner wiring layer thereof a plurality of capacitive load patterns adjacent open-circuited ends of the resonator conductive patterns and electrically isolated from each other; and on one of the dielectric insulating layers, a plurality of capacitive load adjusting patterns each being electrically connected by at least one corresponding inter-layer connecting via to a corresponding capacitive load pattern;

each of the capacitive load adjusting patterns is formed fringed by a framed-shaped insulating pattern between an adjacent portion of the ground pattern; and a MEMS switch is provided on one side of each capacitive load adjusting pattern to selectively make and break a connection between a corresponding capacitive load adjusting pattern and the ground pattern.

3. A filter circuit including a pair of dielectric insulating layers, upper and lower, each having a ground pattern formed on an outer side thereof, and an inner wiring layer formed between the dielectric insulating layers and having capacitively coupled resonator conductive patterns each connected at one end thereof to the ground patterns via inter-layer connecting vias and open-circuited at the other end, the filter circuit having formed:

on the inner wiring layer thereof a plurality of capacitive load patterns adjacent the open-circuited ends of the resonator conductive patterns and electrically isolated from each other; and on one of the dielectric insulating layers, a plurality of capacitive load adjusting patterns, each being electrically connected by at least one corresponding inter-layer connecting via to a corresponding capacitive load pattern;

the capacitively coupled conductive patterns are a pair of resonator conductive patterns, each having one end thereof short-circuited and the other end open-circuited and having a length of $\lambda/4$; and wherein parallel capacitive loading to the conductive patterns is adjusted by selectively connecting one or more of the capacitive load adjusting patterns to the ground pattern.

4. A filter circuit including a pair of dielectric insulating layers, upper and lower, each having a ground pattern formed on an outer side thereof, and an inner wiring layer formed between the dielectric insulating layers and having capacitively coupled resonator conductive patterns each connected at one end thereof to the ground patterns via inter-layer connecting vias and open-circuited at the other end, the filter circuit having formed:

on the inner wiring layer thereof a plurality of capacitive load patters adjacent the open-circuited ends of the resonator conductive patterns and electrically isolated from each other; and on one of the dielectric insulating layers, a plurality of capacitive load adjusting patterns, each being electrically connected by corresponding inter-layer connecting via to a capacitive load pattern;

each capacitive load adjusting pattern is formed fringed by a frame-shaped insulating pattern between an adjacent portion of the ground pattern;

a MEMS switch is provided on one side of each capacitive load adjusting pattern to selectively make and break a connection between an associated capacitative load adjusting patterns and the ground pattern;

an output monitoring means is provided downstream of the resonator; and the MEMS switch is turned on and off under a control signal supplied from the output monitoring means.

* * * * *